US007775898B1

(12) United States Patent
Allen

(10) Patent No.: US 7,775,898 B1
(45) Date of Patent: Aug. 17, 2010

(54) GOLF ROBOT ARM

(76) Inventor: Dillis V. Allen, 31W211 Route 58, Elgin, IL (US) 60120

( * ) Notice: Subject to any disclaimer, the term of this patent is extended or adjusted under 35 U.S.C. 154(b) by 0 days.

(21) Appl. No.: 12/292,706

(22) Filed: Nov. 21, 2008

(51) Int. Cl.
*A63B 69/36* (2006.01)

(52) U.S. Cl. ..... 473/214; 473/207

(58) Field of Classification Search ..... 473/207, 473/212, 214, 447, 448, 450; 602/14, 16, 602/20, 26, 63
See application file for complete search history.

(56) References Cited

U.S. PATENT DOCUMENTS 3,339,926 A * 9/1967 Coupar ..... 473/214
3,419,276 A * 12/1968 Poggioli ..... 473/214
4,575,089 A * 3/1986 Corbett et al. ..... 473/214
4,718,665 A * 1/1988 Airy et al. ..... 482/119
5,472,206 A * 12/1995 Manley et al. ..... 473/214
5,865,695 A * 2/1999 Mahala et al. ..... 473/450
5,954,621 A * 9/1999 Joutras et al. ..... 482/114
7,367,958 B2 * 5/2008 McBean et al. ..... 602/16
2003/0212356 A1 * 11/2003 Scorvo ..... 602/20

* cited by examiner

*Primary Examiner*—Nini Legesse
(74) *Attorney, Agent, or Firm*—Dillis V. Allen, Esq.

(57) ABSTRACT

A golf swing training system that straps to the rear or trailing arm of the golfer and guides movement of that arm to correctly delay release of the golf club on the downswing until the trailing arm bicep is approximately pointing toward the ground. A servo motor locks the trailing arm at the elbow from extension near the top of the backswing as the trailing arm reaches its fully bent position preventing premature club release during the initial downswing, and releases the elbow when the upper arm reaches a near vertical position on the downswing. The entire system is controlled by an on-board microprocessor encoded by input angle signals of the trailing arm bending movement adapted to the swing cycle of the individual golfer under study.

20 Claims, 10 Drawing Sheets

RESET
HAS SWING BEGUN
76
NO YES
N
77
LESS THAN 80°
Y
MORE THAN 80°
DO NOT START SWING CYCLE
78
START SWING BEGIN ANGLES
79
MEASURE STOP & REVERSAL OF ARM SWING
N
DO NOT START WINDOW
Y
PTA ≈ 200ms
CHANGE DOWNSWING WINDOW
START THE DOWNSWING WINDOW 300 600ms
81
80
IS B>10°
DO NOT APPLY BRAKE
Y
81
APPLY BRAKE
83
HAS WINDOW EXPIRED
N
DO NOT RELEASE BRAKE
Y
RELEASE BRAKE

GOLF ROBOT ARM

BACKGROUND OF THE INVENTION

The present invention relates to a golf swing training system that attempts to delay the release of the golf club on the downswing to maximize club head velocity at golf ball impact to increase ball exit velocity from the club head at impact.

The distance and trajectory of a golf ball is controlled by a variety of factors several of which are not dealt with in the present invention and several are. One is the extension of the golf swing arc on the backswing predominantly influenced by the golfer keeping his hands during the backswing as far as possible away from his body. Another is the setting of his wrists during the backswing and the downswing. The timing of the cocking and uncocking of the wrists during the backswing and the downswing not only affects club head speed at impact, but also ball launch angle and ball spin rate and a variety of other flight factors that are not relevant to this discussion.

There is an increasing contemporary swing teaching influence to set the wrists earlier in the backswing when the straight lead arm is parallel to the ground in the backswing, the wrists should in this method be fully cocked with the club shaft 90 degrees to the lead arm pointing toward sky. But in any event, the wrists should be fully set or cocked at least at a club shaft 90 degree angle to the leading arm somewhere in the backswing or in some cases during the downswing.

Some of the great golfers actually cock or increase the cocking of their wrists during the downswing. By increasing the cocking angle either before or during the downswing and delaying the release of the club shaft, the time period during release decreases and this is what leads to faster club head speeds at impact.

Both Jack Nicklaus and Sergio Garcia, both great swingers of the driver, decrease the angle between the driver shaft and the leading arm during the downswing. What this does is increase the arc length through which the club head must travel to square at impact and at the same time reduces the time for the club head to travel through that longer arc—both influences increasing the velocity of the club head at impact.

The present invention does not deal with increasing wrist cocking during the downswing, or even setting or cocking the wrists properly during the backswing, both of which are important to correct golf swing mechanics.

The present invention encourages the late release of the club head during the downswing. The later the release of the club head the shorter the time in the total downswing cycle the golfer has to square the club head at impact which mandates greater club head speed between release initiation and impact.

There have been attempts in the past to control the release of the club head during the downswing. John Billing, in his U.S. Pat. No. 5,108,103, explains a strapping system on the golfer's leading arm that attempts to control release by the bending movement of the leading arm. But club head release is not significantly controlled by the bending movement in the leading arm, because the leading arm most productively remains straight during the downswing.

The late club head release has been approached by many inventors including Mike Snyder in his U.S. Pat. No. 6,863,616. Most of these late club head release devices include a string attached to the club head at one end and attached at some point to the golfer's body at the other end; such as one of his arms, or his back, or his foot. In Mr. Snyder's case, he attaches one end of the string to the golf shaft and the other end of the string to the golfer's rear forearm as seen in FIG. 6C to FIG. 6G of the patent.

The technical problem in the Snyder patent is the methodology for releasing the string and permitting the golfer to release the golf club to the ball.

In Snyder, the release is triggered by the extension of the trailing arm. What does that mean? It means, if the golfer casts the club at the top of the downswing, the string 46 will release permitting the golfer to prematurely release his wrist, losing club head velocity at impact.

Thus, the problem with prior delayed club head release devices is the myopic focus on the golfer's wrists, when in reality the trailing arm of the golfer is what initiates the release of the club head, whether it be early, prematurely or correctly late.

So it is in part the primary object of the present invention to ameliorate the problems noted above in swing training devices that attempt to delay the release of the club head during the downswing.

SUMMARY OF THE PRESENT INVENTION

In accordance with the present invention, a programmed robotic golf swing training system is provided that guides the movement of the golfer's trailing arm during the golf swing to enhance ball impact speed, ball launch angle, and ball spin rate. The trailing or rear arm for a right-handed golfer (RH) is his or her right arm.

The present invention is cornerstoned on the principle that the trailing arm movement controls a major portion of backswing and downswing to ball impact (half of the golf swing). The leading arm, the left arm in an RH golfer remains or should remain straight during the backswing and the downswing, and does not in a correct swing control the release of the club head during the downswing. Nor is the release of the wrists during the downswing the initiator of the club head release as many teachers extol, although the release of the wrists obviously is what generates club head speed. But the wrist release speed is within the talent and skill of the individual golfer. What is principled in the present swing training system is that (1) the extension of the trailing lower arm from the trailing upper arm is what initiates the release of the club head on the downswing; and (2) by delaying the extension of the lower trailing arm from the upper trailing arm during the downswing increases club head speed at ball impact, increases ball launch angle, and reduces ball exit spin rate.

How is all this accomplished? It is accomplished by a servo motor attached to the golfer's trailing or rear arm that mandates the movement of the trailing arm during the golf swing. While the embodiment of the invention disclosed in this application only guides movement of the golfer's trailing arm during the downswing, it should be understood that the principles of the present invention could be applied to a system that guides the trailing arm of the golfer through the backswing, downswing and follow through of the golf swing.

Generally, the present golf swing training system straps to the rear or trailing arm of the golfer and guides movement of that arm to correctly delay release of the golf club on the downswing until the trailing arm bicep is approximately pointing toward the ground. A servo motor locks the trailing arm at the elbow from extension near the top of the backswing as the trailing arm reaches its fully bent position preventing premature club release during the initial downswing and releases the elbow when the upper arm reaches a near vertical position on the downswing. The entire system is controlled by an on-board microprocessor encoded by input angles of the trailing arm bending movement adapted to the swing cycle of the individual golfer under study.

This system's hardware includes a rigid upper arm brace "Velcro"ed™ to the bicep and a rigid lower arm brace "Velcro"ed™ to the trailing lower arm. The pivotal connection between the upper arm brace and the lower arm brace is at the elbow by a servo motor or electromagnetic brake.

One important aspect of the general principles of the present invention is that the extension of the lower trailing arm from the upper trailing arm is what triggers in part, the release of the club during the downswing. The prior art theory that premature club release is caused by premature wrist release only is based on the misconception that the wrists can be released early in the downswing without releasing the trailing lower arm from the trailing upper arm. They occur approximately at the same time. It is far simpler to control movement of the trailing arm than to control movement of the wrists by strings or other crude or ineffective devices.

The electromagnetic brake has an annular stator and axially movable armature plate mounted near the trailing elbow to selectively lock and release elbow angular movement. Because the servo motor is only several inches in diameter the braking force is increased accordingly to the present invention by providing radial "V" shaped serrations in the braking pads to dramatically increase the braking force.

Another important aspect of the present invention is that the programmed microprocessor for the servo motor is carried on board, on one of the arm braces, and is powered by a 24-volt power supply carried on a golfer mounted belt, on his/her back (not shown in the drawings).

In addition to the 24-volt power supply provided for the microprocessor, the microprocessor is programmed by software that enables all the timing cycles of the servo motor, and the movement of the servo motor, to be varied to the swing of the specific student golfer under consideration. For example, the cycle time and angular movement of the golfer's waggle can be varied to prevent the swing cycle from resetting.

Next, the swing angles are variable that determine the transition from the top backswing to the downswing.

Following that, the angular degree of extension of the trailing lower arm from the trailing upper arm to initiate servo motor braking of the trailing arm can be adjusted to suit the student's swing characteristics.

Further, after initiation of the servo motion control of the trailing arm at or near the top of the backswing, a time clock is started to begin controlling the downswing cycle. At the end of that controlling cycle, the golfer's trailing arm is released from control permitting it to swing freely through impact. That control cycle is also adjustable according to the present invention to accommodate the swing of the individual golfer.

While the specific embodiment of the present invention does not control the golfer's swing after release of the trailing arm after the pre-release cycle is completed, it should be understood that the present invention, in its broadest context, contemplates control of the golfer's swing through servo motors mounted at the human body joints in the arms and legs that dictate movement of those joints throughout the golf swing, in one or all of those joints.

DETAILED DESCRIPTION OF THE PREFERRED EMBODIMENT

Figure 1:
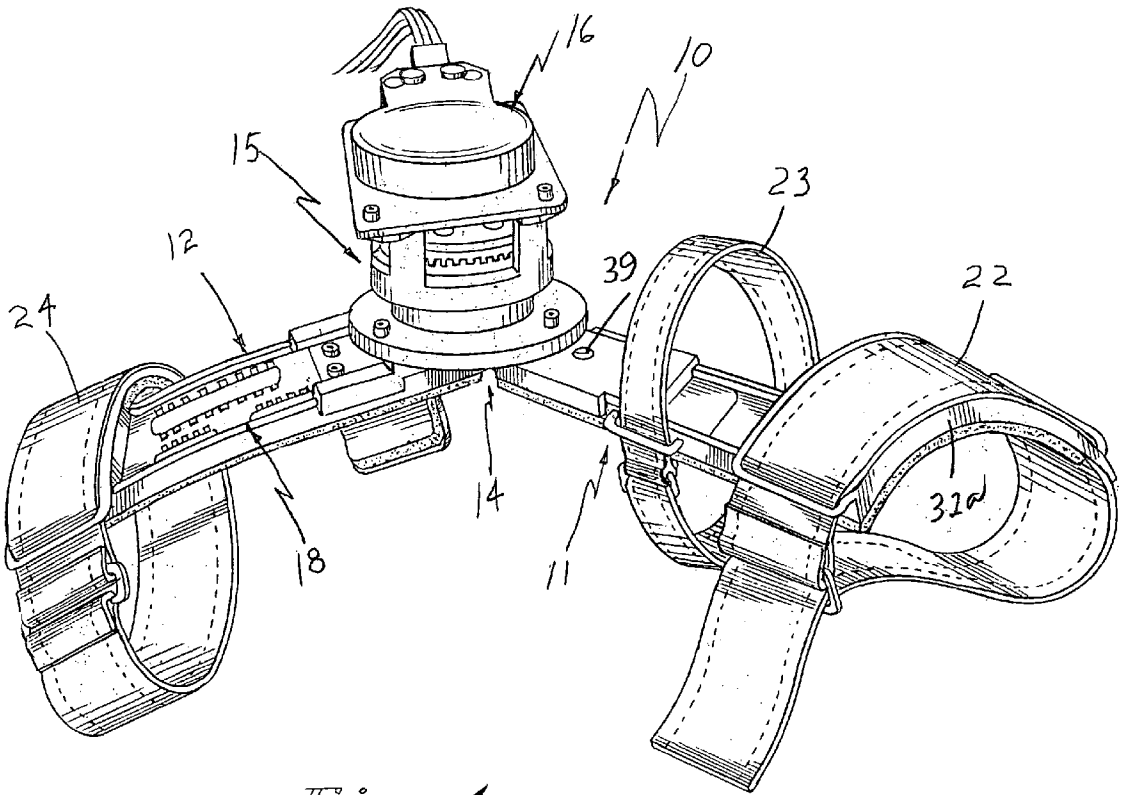
FIG. 1 is a top perspective of the present golf swing training system unattached to the golfer.

Referring to the drawings and particularly FIGS. 1 to 7, and referring initially to FIG. 1, a programmable robotic swing training system is illustrated depicted generally by the reference numeral 10, and is seen generally to include an upper arm portion assembly 11 and a lower arm portion assembly 12 connected together at an elbow hinge 14. A servo motor assembly 15 guides the pivotal movement of the lower arm assembly 12 with respect to the upper arm assembly 11. An optical encoder 16 is driven by the servo motor 15 and provides signals to an onboard microprocessor 18 to guide the golfer's lower arm movement with respect to his upper arm movement throughout the golf swing.

Figure 2:
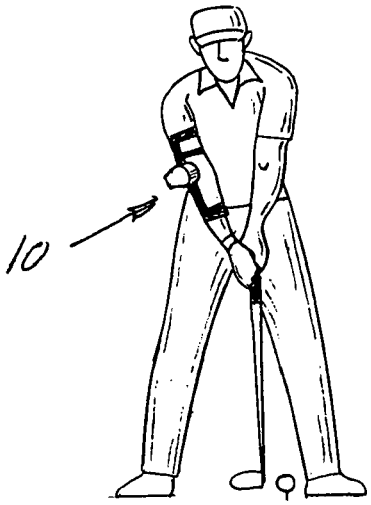
FIGS. 2 and 3 are orthogonal views respectively of a golfer with the present golf swing training system installed on the golfer's trailing arm at the ball address position.
Figure 3:
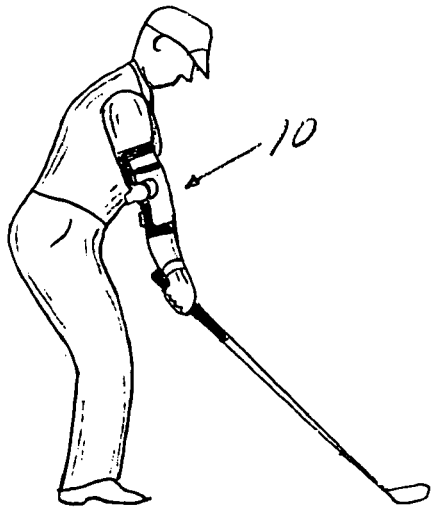
Figure 21:
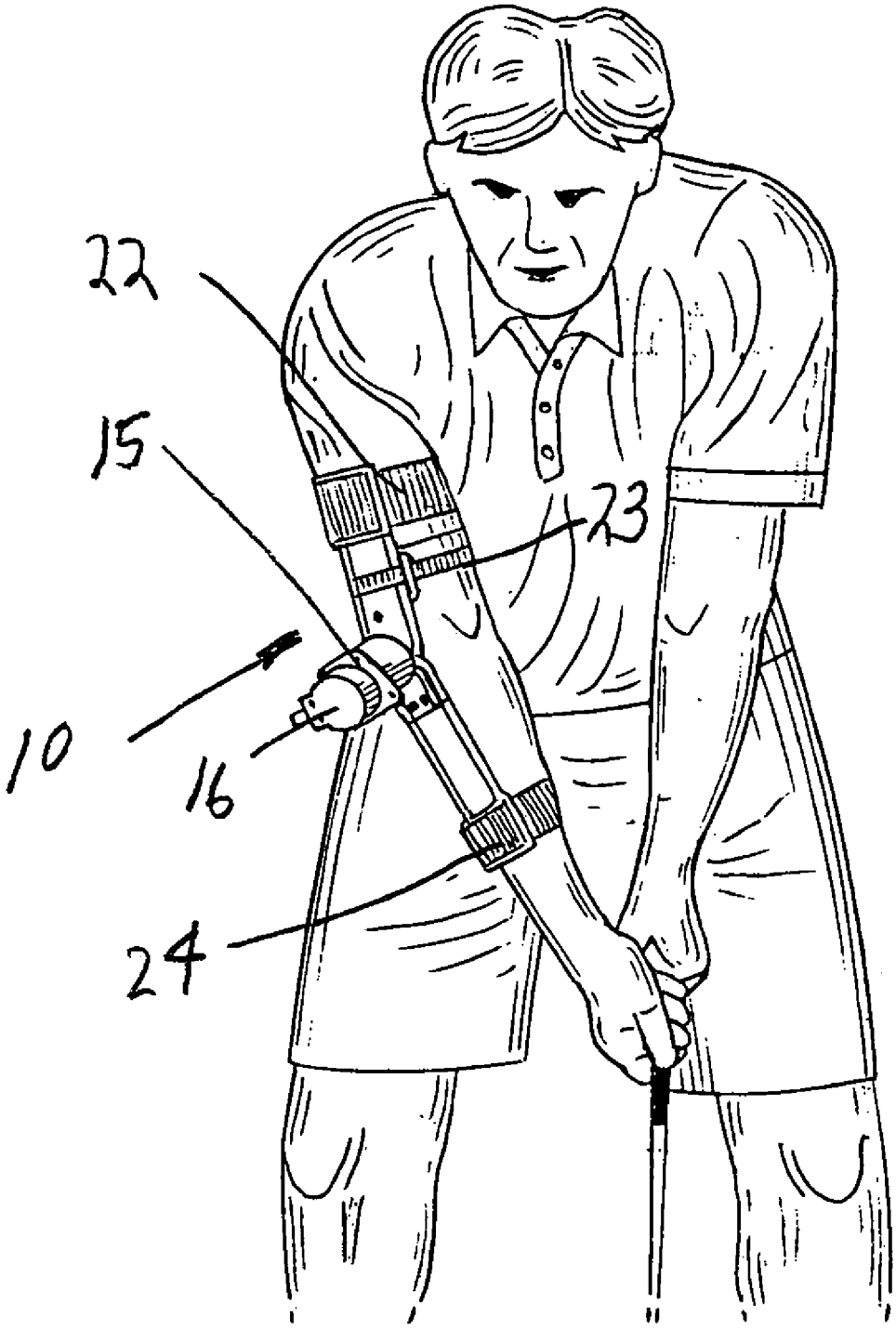
FIG. 21 is a view similar to FIG. 2 enlarged to show somewhat more detail how the present golf swing training system is strapped to the golfer's trailing arm.

A pair of Velcro upper arm straps 22 and 23, which are maintained in position by integral loops on the upper arm assembly 11 and a single wide lower arm Velcro strap 24, which is supported on integral loops on the lower arm assembly 12, all hold the programmable robotic swing training system 10 in position on the golfer's trailing arm as shown in FIG. 21. The swing training system 10 is illustrated in dynamic positions on an actual golfer in FIGS. 2 to 7, as well as in FIG. 21. This sequence of pictures in FIGS. 2 to 7 is intended to replicate the golf swing of professional golfer Padriq Harrington with the robotic swing training system 10 in position. FIGS. 2 and 3 depict the address position of the swing trainer and at address the swing trainer senses the actual take away of the golfer's swing, ignoring preliminary waggles, to begin the cycle of the swing training system 10. At the top of the swing illustrated in FIGS. 4 and 5, the swing training system senses when the golfer is approaching or reaching the top of the golf swing to initiate the timing cycle of the downswing. If during the downswing cycle the golfer begins to extend his trailing arm 26, the training system 10 will block or brake the extension of the trailing arm 26 to maintain its approximate right angle position illustrated in FIGS. 4 and 5. When the golfer reaches the just prior to release position in FIGS. 6 and 7, which is achieved when the bicep 27 nears the golfer's right side and is approximately in the vertical position pointing toward the ground, the servo motor 15 releases the lower arm brace assembly 12 from the upper arm brace assembly 11 permitting the golfer to release the lower trailing arm from the upper trailing arm in the golfer's position of FIGS. 6 and 7, which is what initiates the release of the golfer's wrist 29 and the club head 30 at high speed into the golf ball.

An important aspect of the present invention is that it keys on the release of the trailing lower arm 28 from the upper arm 27 and that in fact is what initiates the release of the wrists 29 and the club head 30 into the golf ball.

Figure 8:
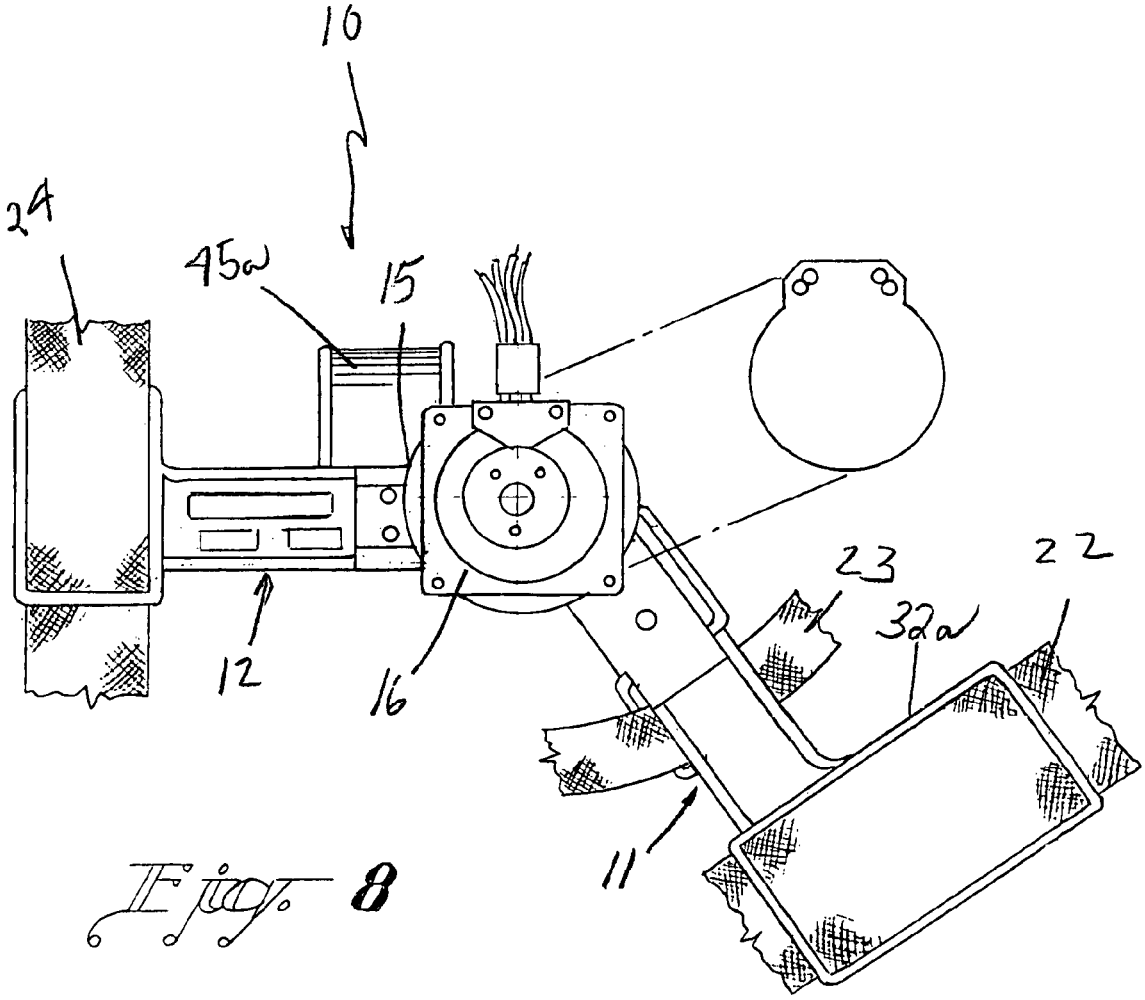
FIG. 8 is a top view of the golf swing training system illustrated in FIG. 1.
Figure 9:
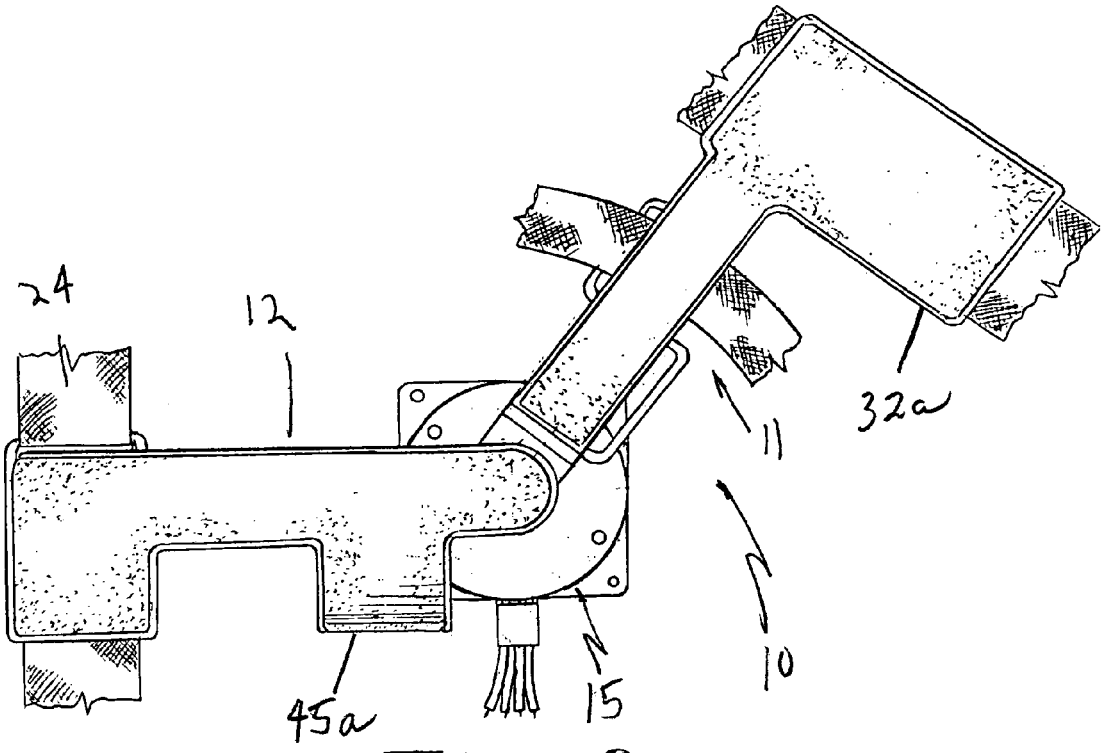
FIG. 9 is a bottom view of the golf swing training system illustrated in FIG. 1.
Figure 10:
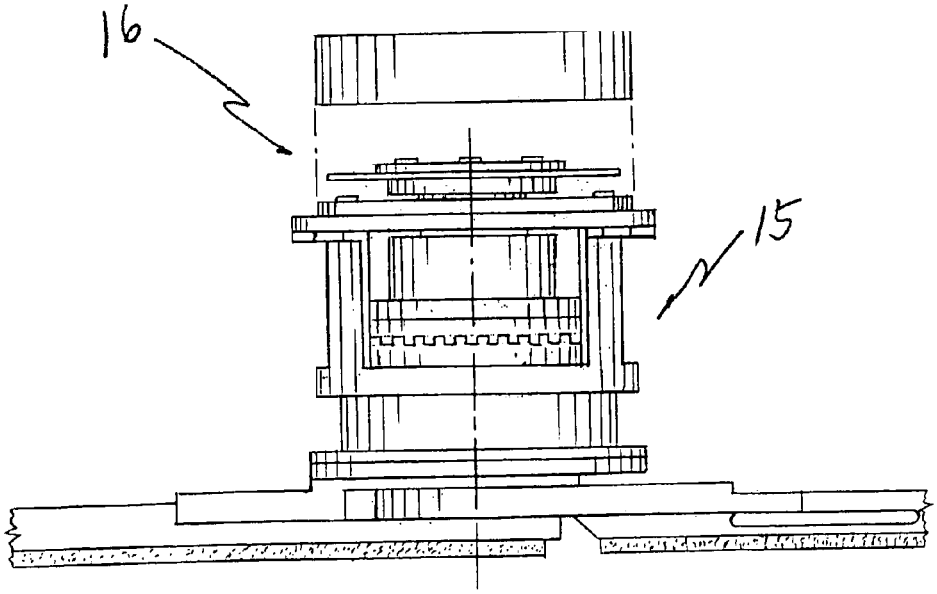
FIG. 10 is a partly exploded fragmentary side view of the golf swing training system illustrated in FIG. 1.
Figure 14:
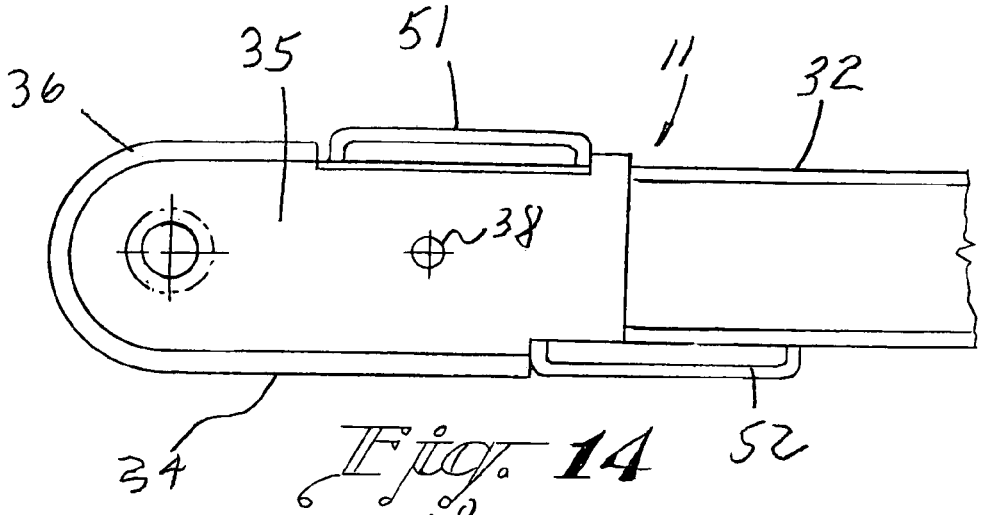
FIG. 14 is a sub-assembly view of the upper arm brace.

As seen in FIG. 14, the upper arm assembly 11 includes a flanged plastic beam 32 that carries the Velcro straps 22 and 23 and an aluminum pivot frame 34 that has a planar central section 35, an arcuate peripheral rib 36, a pivot boss 37, and a fastener receiving bore 38 that receives a fastener 39 connecting the aluminum pivot frame 34 to the flanged plastic beam 32. Plastic beam 32 has an arcuate arm 32*a* that wraps around the bicep to hold the brace 11 against the bicep (see FIGS. 1, 8 and 9). The frame 34 wraps around the flanged plastic beam 32 so that there is no relative pivotal movement there-between and they are held rigidly together.

Figure 11:
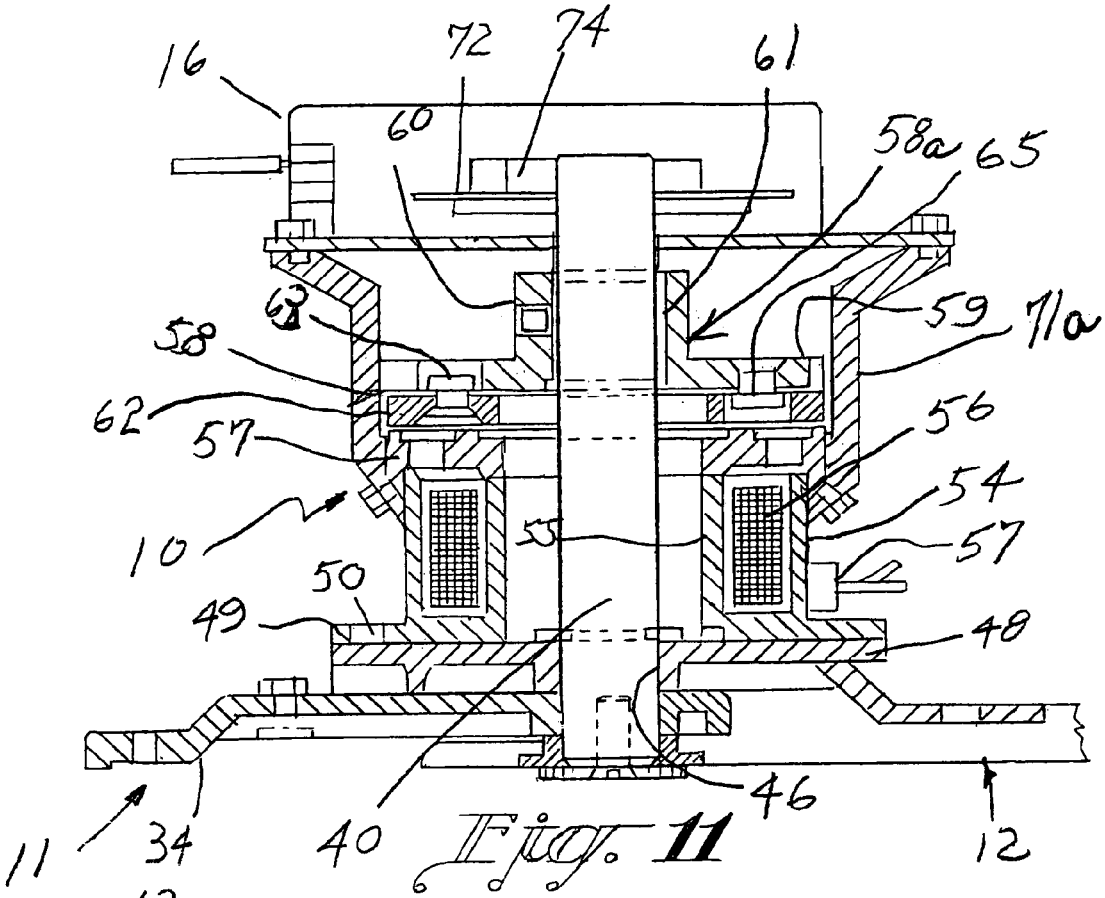
FIG. 11 is a fragmented longitudinal cross-section of the golf swing training system illustrated in FIG. 1 taken axially through the servo motor at the mid point thereof.

As seen in FIG. 11, the aluminum frame 34 supports and is fixed to a pivot shaft 40 controlled by the servo motor 10.

Figure 15:
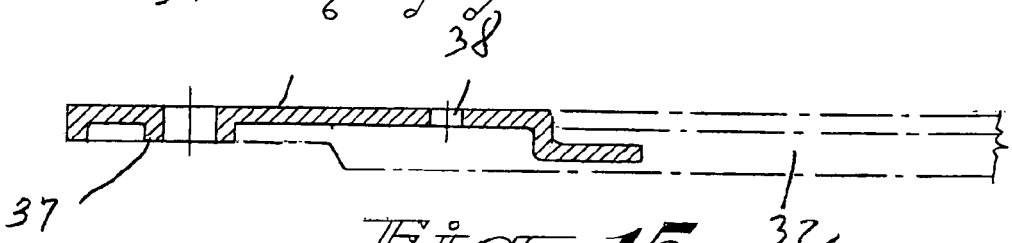
FIG. 15 is a longitudinal section of the upper arm brace illustrated in FIG. 14.
Figure 16:
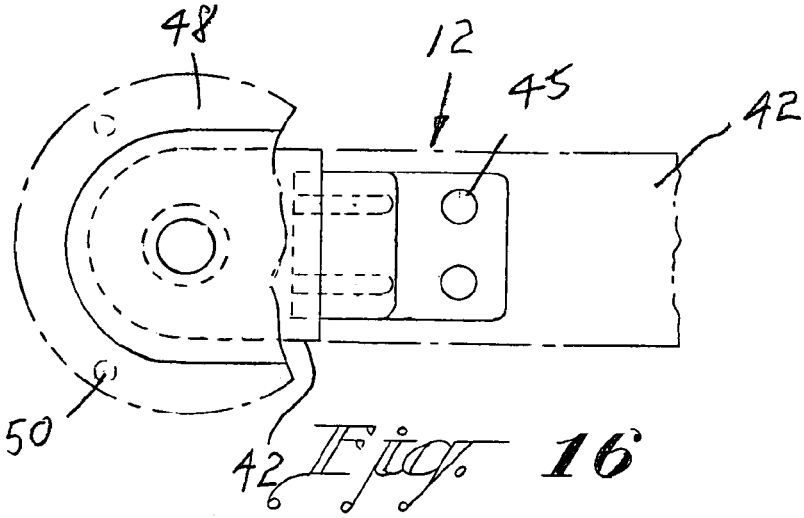
FIG. 16 is a fragmented top view of the lower arm brace.
Figure 17:
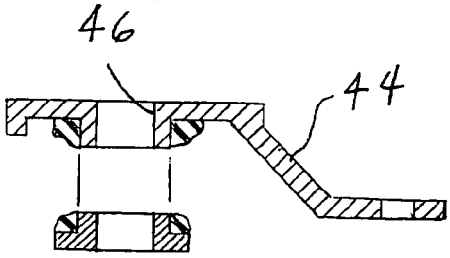
FIG. 17 is a longitudinal section of the metallic frame portion of the lower arm brace illustrated in FIG. 16.

The lower arm brace assembly 12 is depicted in fragmentary form in FIGS. 16 and 17 and is seen to include a flanged plastic frame portion 42 fixed to an aluminum frame member 44, also depicted in FIG. 17, that has a pair of apertures 45 therein that receive fasteners to connect the pivot frame 44 to the plastic frame portion 42. An arcuate arm 45*a* projects from frame portion 42 and wraps around the golfer's forearm to hold the system 10 in position with the aid of the Velcro straps (see FIG. 8). Frame 44 has a aperture 46 therein that also receives, rotatably, servo motor shaft 40 as seen in FIG. 11. As seen in FIGS. 16 and 11, the frame 44 carries a circular plate 48 that is fastened to lower circular base 49 of the servo motor that receives fasteners through apertures 50 therein that are equally spaced around the plate 48 and the base 49, not shown in complete detail in FIG. 15 for the sake of brevity. As seen in FIG. 14, the upper arm assembly 11 has integral loops 51 and 52 to receive the straps 22 and 23 respectively, and while not shown clearly in the drawings, the lower frame assembly 18 has similar loops for receiving the Velcro strap 24.

Figure 4:
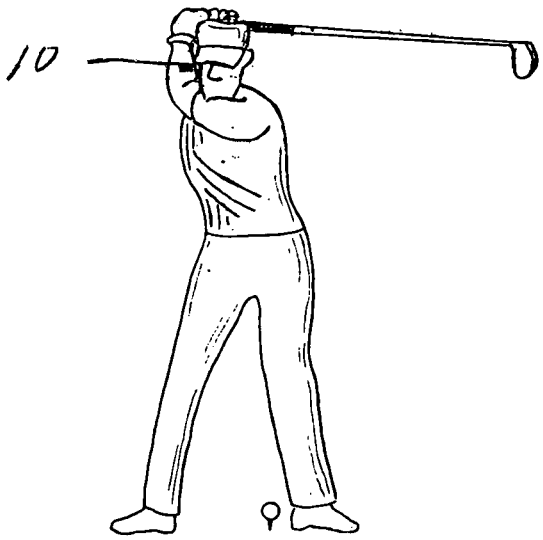
FIGS. 4 and 5 are orthogonal views of the golfer with the present golf swing training system installed on the golfer's trailing arm at the top of the back swing.
Figure 5:
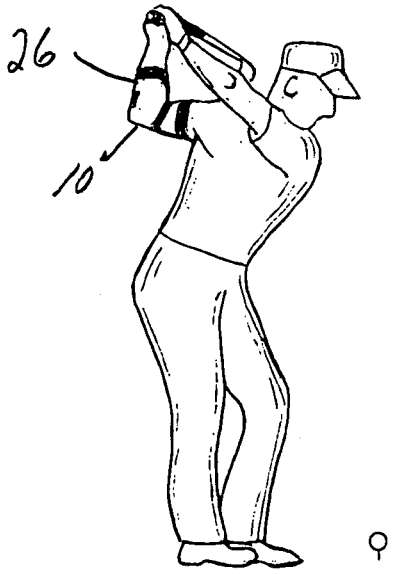
Figure 6:
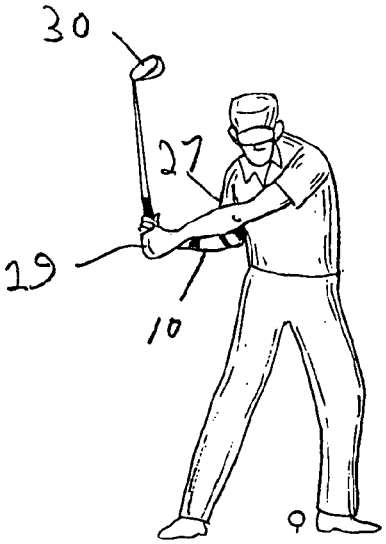
FIGS. 6 and 7 are orthogonal views of the golfer with the present golf swing training system installed at the fully loaded position of the downswing prior to club head release with the golfer's trailing arm bicep against the right side and pointed downwardly.
Figure 7:
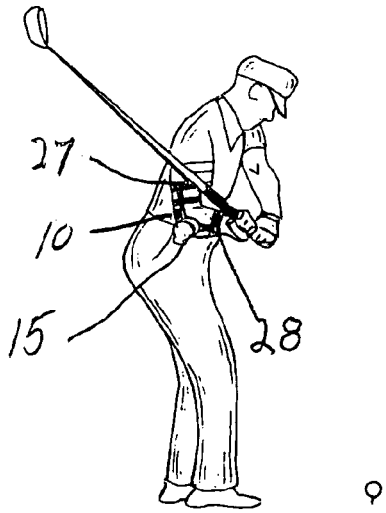

Viewing FIG. 11, for a description of servo motor 10, it should be understood that the servo motor contemplated by the present invention can either be a servo motor that controls the release of the club head in the golfer's downswing, or it can continuously control movement of the golfer's lower arm 28 with respect to his upper arm 27 throughout the golf swing, but the servo motor specifically depicted in FIG. 11 functions: a) to brake the golfer's extension of the lower arm 28 with respect to the upper arm 27 during the downswing so that the golfer maintains the trailing arm in approximately a 90 degree position between the top of the swing depicted in FIGS. 4 and 5, and the true release position in FIGS. 6 and 7 when the golfer's upper arm is vertical.

Figure 12A:
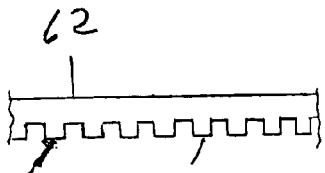
FIG. 12*a* is a fragmented side view of the servo motor armature plate.
Figure 12:
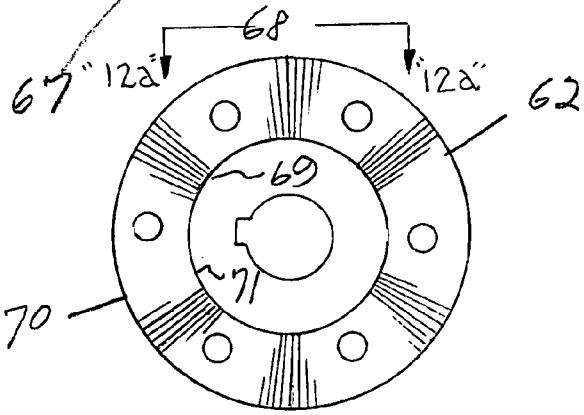
FIG. 12 is a bottom view of the armature plate of the servo motor showing the radial teeth thereon.
Figure 13:
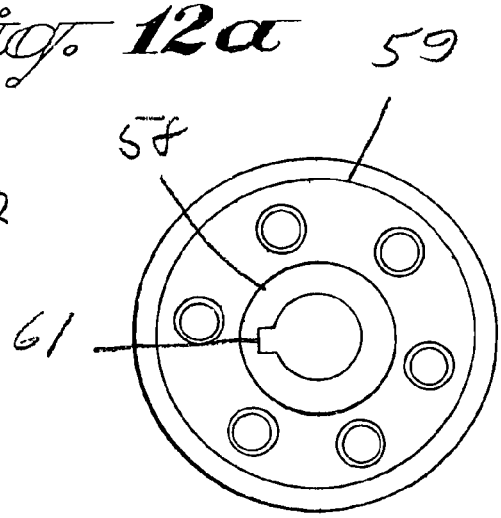
FIG. 13 is a top view of the armature plate frame.

Viewing FIG. 11, the servo motor includes spaced annular housing walls 54 and 55 integrally extending upwardly from base plate 49 and housing there-between an annular electromagnetic coil 56 powered through a conductor assembly 57*a*, which is connected to one of the outputs of the microprocessor 18. Conductor assembly 57*a* is powered by a 24-volt backpack carried on the golfer's waist. The housing assembly of the servo motor has a stator plate 57 enclosing the coil assembly 56 that cooperates with an armature assembly 58 fixed to the servo motor shaft 11. The armature assembly 58 includes an armature frame 58*a* consisting of a plate portion 59 and a reduced annular boss portion 60 that is keyed at 61 to the servo motor shaft 40. The plate portion 59 carries an axially movable annular armature plate 62 that is mounted on the plate portion 59 by a plurality of pins 63 that permit axial movement between the armature plate 62 and the plate portion 59. A plate spring assembly 65 forces the armature plate 62 against the bottom surface of the plate portion 59 but permits relative movement there-between as the armature coil 56 attracts the armature plate 62 into engagement with the stator 57 locking plate 62 to stator plate 57. Both the lower surface of the armature plate 62 and the upper surface of the stator plate 57 have a plurality of interengaging radial teeth 67 depicted in FIGS. 12 and 12*a*. The outer peripheries of the teeth 67, as shown at 68, are square-shaped while the inner ends 69 of the teeth come to a point to accommodate the difference in diameter between the outer diameter of the armature plate 70 and the inner diameter 71. The innerengagement of the teeth 67 on the armature plate 62 and the stator plate 57 substantially increases the braking force of the servo motor 10 and is an important aspect of the present invention.

The servo motor 10 is similar to the electromagnetic brake manufactured by Lenze AG located in Germany, Model Magneta No. 14.110 and 14.100, Size 05, 24-volt DC flanged mounted with 12 mm. central bore. The encoder 16 provides square wave signals illustrated in FIG. 20 to the microprocessor 18 illustrated in block diagram form in FIG. 19 to provide angle data and direction of rotation data to the microprocessor so that the microprocessor 18 may control the braking function of the servo motor 10 at appropriate times. The encoder 16, as seen in FIG. 11, is supported on the servo motor housing by four brackets 71*a* fastened to servo motor housing wall 54. One encoder that has been found suitable for this use is manufactured by US Digital Corporation entitled "Optical Kit Encoder", Model No. E3, Codes 472, of E3-500-472-10-PKG3.

Figure 20:
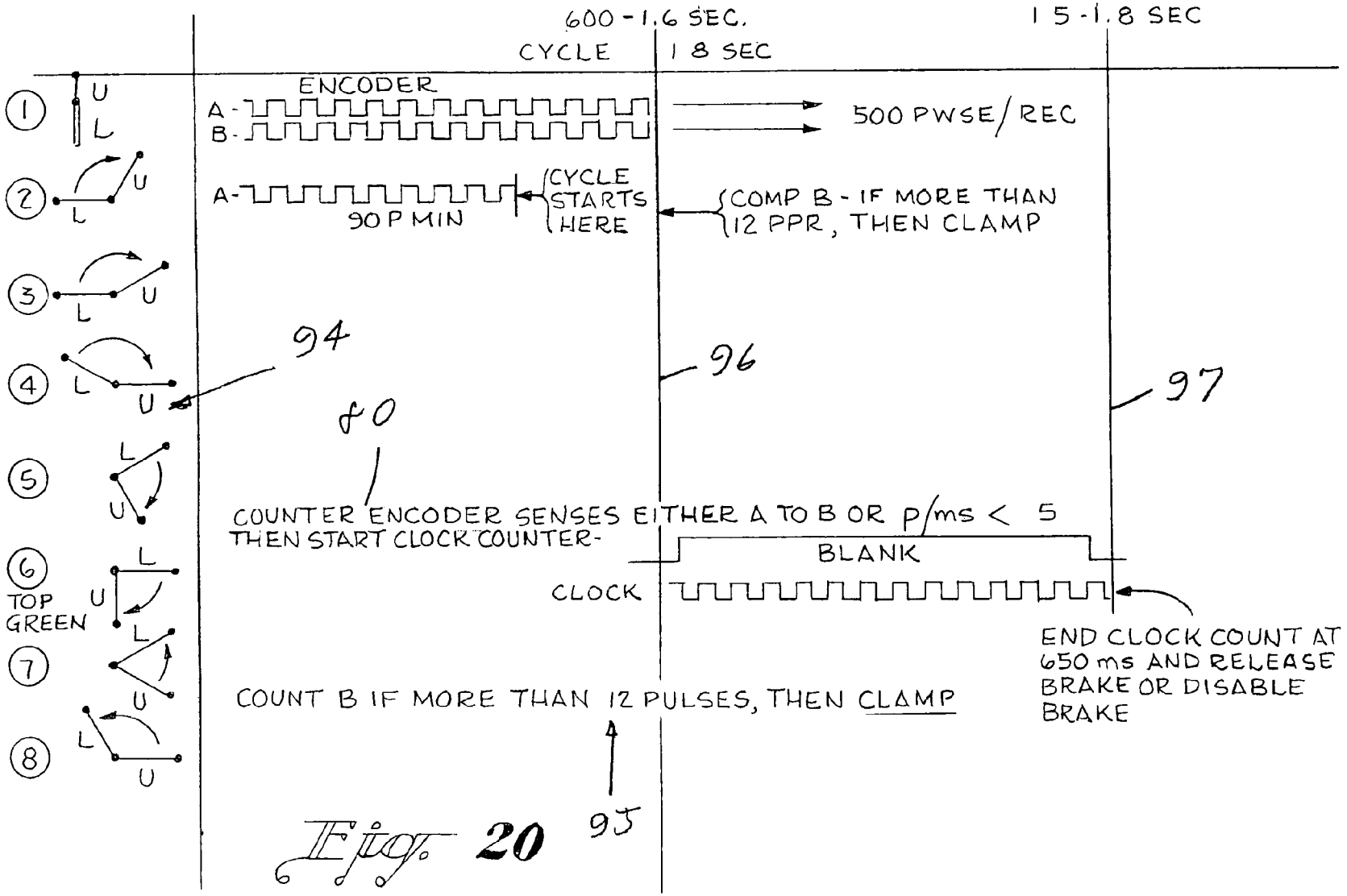
FIG. 20 is a time line cycle for the encoder signals and the clock pulses during a complete cycle of the present golf swing training system.

The encoder 16 is an optical encoder and includes a thin plastic annular disc 72 that has a plurality of optical apertures therein through which LED light is projected by an optical circuit assembly 74 that generates a plurality of pulses and signal conditioning including the pulses A and B from the encoder illustrated in FIG. 20 to the microprocessor 18.

This encoder generates 360 pulses per revolution, and it generates one series of pulses A for counter-clockwise revolution, and one series of pulses B for clockwise revolution and also generates a reference signal at a certes a plurality of pulses and signal conditioning including the pulses A and B from the encoder illustrated in FIG. 20 to the microprocessor 18.

This encoder generates 360 pulses per revolution, and it generates one series of pulses A for counter-clockwise revolution, and one series of pulses B for clockwise revolution and also generates a reference signal at a certain angular relationship between the upper arm assembly 11 and the lower arm assembly 12 so that there are at least three signals going from the encoder 16 to the microprocessor 18.

Figure 18:
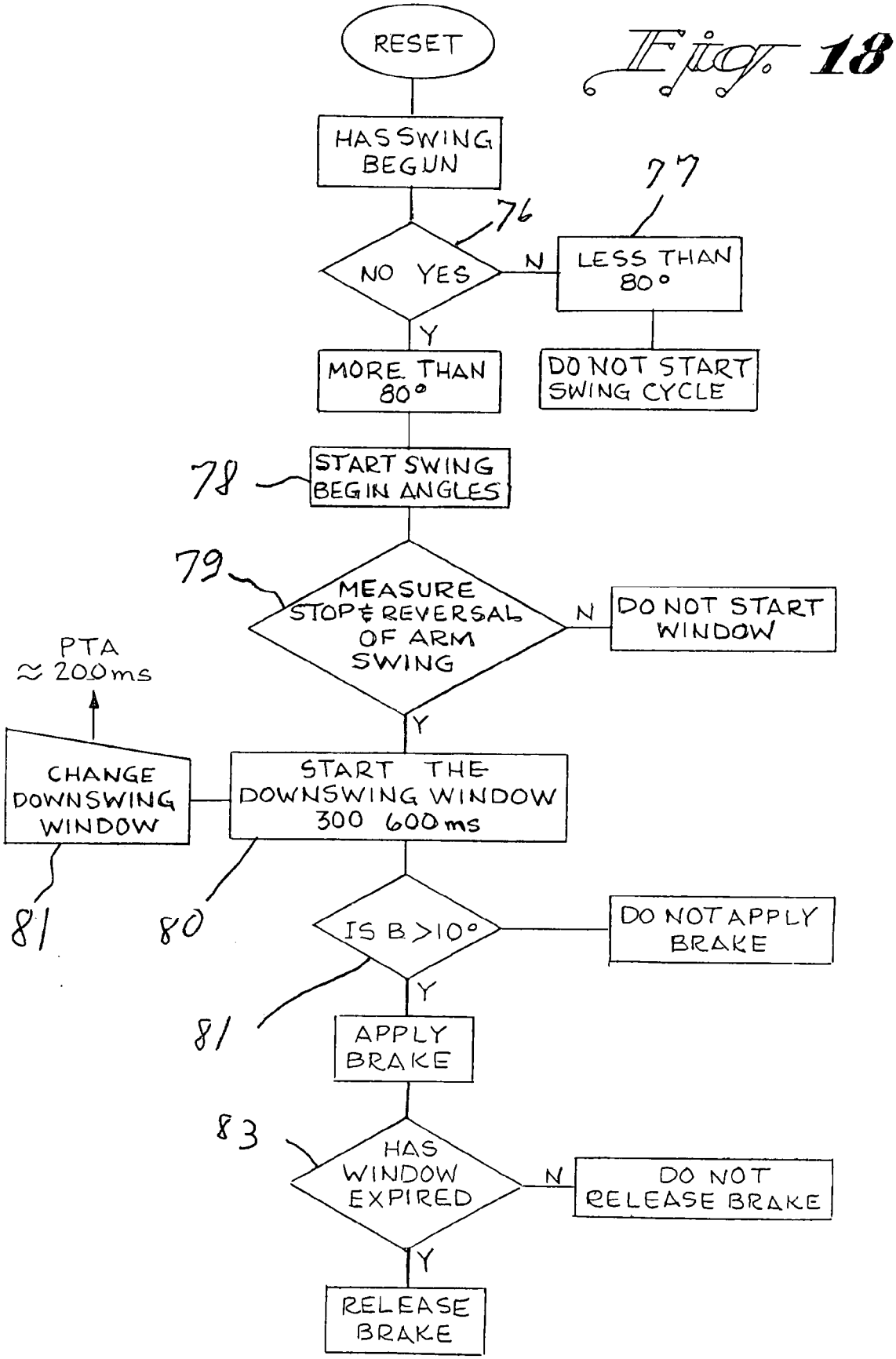
FIG. 18 is a flow sheet for the software of the on-board microprocessor that controls the present golf swing training system.

In FIG. 18, the software for the microprocessor 18 is illustrated, and as shown it has a reset function and a function that determines whether the swing has begun or not. This function is necessary to prevent the cycle from being started if the golfer is simply waggling the golf club and moving his arms back and forth in waggle fashion, and this is determined by sensing the degree of pivot of the lower arm 28 with respect to the upper arm as shown at 76 and 77.

After the swing has actually begun, the microprocessor begins counting the swing angles at 78 and determines the top of the swing at 79 by determining when either the A signal changes to the B signal from the encoder as shown at 80

Figure 19:
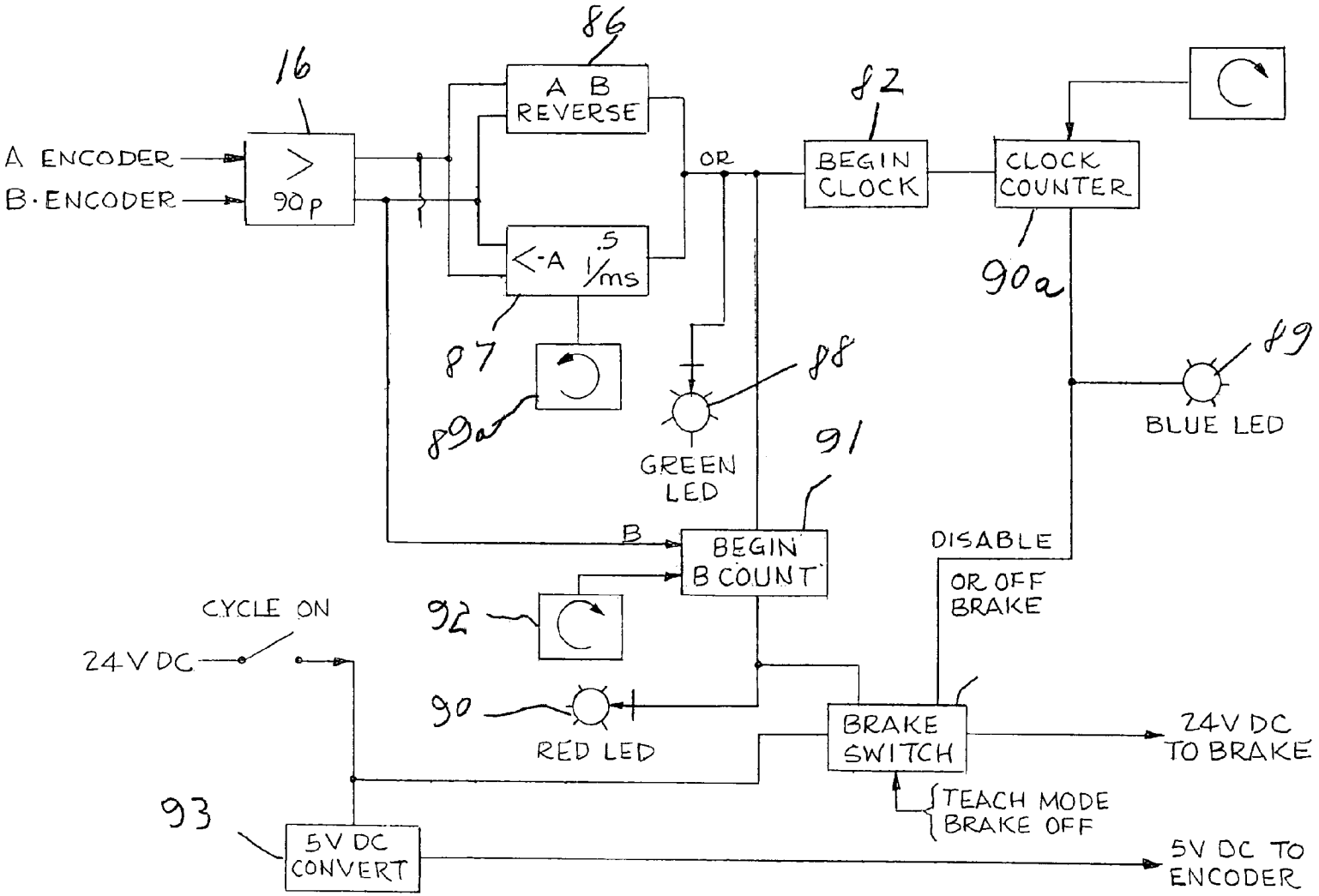
FIG. 19 is a block diagram of the on-board circuit board and microprocessor incorporated in the present golf swing training system.

When the downswing begins at 80, the clock starts at 82 in the block diagram of FIG. 19 so that it begins developing a window of 30 to 600 milliseconds that can be varied at 81 to the individual golfer's swing speed[1]. The brake can be applied any time during this variable downswing window if the B pulse count illustrated at 81 is greater than a predetermined value which can be varied to the golfer, and if less than that value, the brake will not be applied. After the variable window has expired at 83, the brake will be released and the golfer can begin his release from the FIGS. 6 and 7 position.

1. Golfer Peter Jacobson's downswing has been timed at 570 ms.

It should be understood that certain variations of the software in FIG. 18 are within the scope of the present invention. For example, one variable would be to always engage the brake at the top of the backswing regardless of whether the golfer begins casting or extending his lower arm from his upper arm. requiring somewhat similar software.

The block diagram in FIG. 19 is a representation of the microprocessor function as programmed by the software in FIG. 18. At 86, the microprocessor senses an AB reversal at the top of the backswing at 87 and an alternate function can be achieved where the top of the backswing is sensed by a diminution of the rate of the A signal from the optical encoder 18. Lights 88, 89 and 90, which can be carried by the onboard microprocessor 18, or by a remote wireless receiver, can be utilized by the instructor to vary the parameters of the training system 10 to accommodate the specific golfer's swing speed and habits.

The top of swing sensor is variable as indicated at 89*a*. The clock counter 90*a* and the begin B count function 91, which is variable at 92, determines the window at 80 shown in FIG. 18 and the brake is actuated when the B count exceeds a value within the window determined at 81 in FIG. 18.

The entire system is a 24-volt system as indicated with a 5-volt DC converter 93 to drive the encoder and also supplies 24-volts to the coil 56.

The arm positions are illustrated sequentially at 94 in FIG. 20, and at 95 indicates that when Count B is more than 12 pulses, in this case indicating a 12 degree extension of the lower arm relative to the other arm, then clamping occurs but this is a variable. FIG. 20 represents a clamping line 96 and an unclamping at line 97.

The invention claimed is:

1. A swing training system for a golfer's rear trailing arm of a golfer having a forward arm and a rear arm, each having an upper arm and a lower arm, during a golf swing including a backswing and a downswing, comprising: a brace for the golfer's rear upper arm, a brace for the golfer's rear lower arm, and a servo motor between the golfer's rear upper arm brace and the golfer's rear lower arm brace, said servo motor delaying the release of the golfer's lower arm with respect to the golfer's upper arm during the downswing.

2. A swing training system for a golfer's rear trailing arm of a golfer having a forward arm and a rear arm, each having an upper arm and a lower arm, during a golf swing including a backswing and a downswing as defined in claim 1, wherein the servo motor guides the golfer's lower arm through a pattern of movement relative to the upper arm.

3. A swing training system for a golfer's rear trailing arm of a golfer having a forward arm and a rear arm, each having an upper arm and a lower arm, during a golf swing including a backswing and a downswing as defined in claim 1, wherein the servo motor limits extension of the lower arm relative to the upper arm during the downswing.

4. A swing training system for a golfer's rear trailing arm of a golfer having a forward arm and a rear arm, each having an upper arm and a lower arm, during a golf swing including a backswing and a downswing as defined in claim 1, wherein the servo motor includes an angle encoder.

5. A swing training system for a golfer's rear trailing arm of a golfer having a forward arm and a rear arm, each having an upper arm and a lower arm, during a golf swing including a backswing and a downswing as defined in claim 4, wherein the angle encoder measures the angles between the upper arm brace and the lower arm brace.

6. A swing training system for a golfer's rear trailing arm of a golfer having a forward arm and a rear arm, each having an upper arm and a lower arm, during a golf swing including a backswing and a downswing as defined in claim 1, wherein the servo motor brakes angular movement of the lower arm brace away from the upper arm brace during the downswing.

7. A swing training system for a golfer's rear trailing arm of a golfer having a forward arm and a rear arm, each having an upper arm and a lower arm, during a golf swing including a backswing and a downswing as defined in claim 1, including a microprocessor carried on board in the system either on the upper brace or the lower brace programmed to control the servo motor.

8. A swing training system for a golfer's rear trailing arm of a golfer having a forward arm and a rear arm, each having an upper arm and a lower arm, during a golf swing including a backswing and a downswing as defined in claim 7, wherein the microprocessor has an angle input from the relative angular position of the lower arm brace to the upper arm brace.

9. A swing training system for a golfer's rear trailing arm of a golfer having a forward arm and a rear arm, each having an upper arm and a lower arm, during a golf swing including a backswing and a downswing, comprising: a brace for the golfer's rear upper arm, a brace for the golfer's rear lower arm, and a rotational brake between the upper arm brace and the lower arm brace, said brake delaying the release of the golfer's lower arm with respect to the golfer's upper arm during the downswing.

10. A swing training system for a golfer's rear trailing arm of a golfer having a forward arm and a rear arm, each having an upper arm and a lower arm, during a golf swing including a backswing and a downswing as defined in claim 9, wherein the rear arm has an elbow and the brake is an electromagnetic brake positioned approximately at the rear arm elbow.

11. A swing training system for a golfer's rear trailing arm of a golfer having a forward arm and a rear arm, each having an upper arm and a lower arm, during a golf swing including a backswing and a downswing as defined in claim 10, wherein the electromagnetic brake has an axially movable armature plate.

12. A swing training system for a golfer's rear trailing arm of a golfer having a forward arm and a rear arm, each having an upper arm and a lower arm, during a golf swing including a backswing and a downswing as defined in claim 11, wherein the armature plate has a plurality of radial serrations to increase braking force.

13. A swing training system for a golfer's rear trailing arm of a golfer having a forward arm and a rear arm, each having an upper arm and a lower arm, during a golf swing including a backswing and a downswing as defined in claim 9, including an angle encoder mounted on the brake to measure the angular relation between the upper arm brace and the lower arm brace.

14. A swing training system for a golfer's rear trailing arm of a golfer having a forward arm and a rear arm, each having an upper arm and a lower arm, during a golf swing including a backswing and a downswing as defined in claim 9, including a microprocessor carried on board the system, for controlling activation of the brake.

15. A swing training system for a golfer's rear trailing arm of a golfer having a forward arm and a rear arm, each having an upper arm and a lower arm, during a golf swing including a backswing and a downswing as defined in claim 9, including means for activating the brake after sensing an extension of the lower arm brace from the upper arm brace.

16. A swing training system for a golfer's rear trailing arm of a golfer having a forward arm and a rear arm, each having an upper arm and a lower arm, during a golf swing including a backswing and a downswing, comprising: a brace for the golfer's rear upper arm, a brace for the golfer's rear lower arm, and control means between the upper arm brace and the lower arm brace for dictating movement of the lower arm brace relative to the upper arm brace during the downswing, said control means delaying the release of the golfer's lower arm with respect to the golfer's upper arm during the downswing.

17. A swing training system for a golfer's rear trailing arm of a golfer having a forward arm and a rear arm, each having an upper arm and a lower arm, during a golf swing including a backswing and a downswing as defined in claim 16, wherein the control means delays the release of the lower arm brace from the upper arm brace during the downswing, said control means preventing movement of the lower arm brace with respect to the upper arm brace during a portion of the downswing.

18. A swing training system for a golfer's rear trailing arm of a golfer having a forward arm and a rear arm, each having an upper arm and a lower arm, during a golf swing including a backswing and a downswing as defined in claim 17, wherein the control means during the backswing-downswing transition prevents extension of the lower arm brace from the upper arm brace.

19. A swing training system for a golfer's rear trailing arm of a golfer having a forward arm and a rear arm, each having an upper arm and a lower arm, during a golf swing including a backswing and a downswing as defined in claim 18, wherein the control means releases the lower arm brace from the upper arm brace as the upper arm brace nears or achieves a downward vertical position during the downswing.

20. A swing training system for a golfer's rear trailing arm of a golfer having a forward arm and a rear arm, each having an upper arm and a lower arm, during a golf swing including a backswing and a downswing, comprising: a brace for the golfer's rear upper arm, a brace for the golfer's rear lower arm, control means between the upper arm brace and the lower arm brace for preventing extension of the lower arm brace from the upper arm brace during an initial period of the downswing and permitting extension of the lower arm brace from the upper arm brace during the appropriate club release position of the downswing.

* * * * *